United States Patent [19]

Campbell

[11] 3,943,612

[45] Mar. 16, 1976

[54] DRIVE APPARATUS FOR TENTER FRAMES

[75] Inventor: James W. Campbell, Greenville, S.C.

[73] Assignee: Barbara Cox Campbell, Greenville, S.C.

[22] Filed: June 27, 1975

[21] Appl. No.: 591,057

[52] U.S. Cl. ..... 26/57 E; 26/57

[51] Int. Cl.[2] ..... D06C 3/02

[58] Field of Search ..... 26/57 R, 57 A, 57 E, 61 A, 26/61 B; 74/37; 254/175.7

[56] References Cited

UNITED STATES PATENTS

| | | | |
|---|---|---|---|
| 3,150,431 | 9/1964 | Fazis | 26/57 E |
| 3,216,081 | 11/1965 | Leimer et al. | 26/57 E |
| 3,482,750 | 12/1969 | Mohring et al. | 26/57 E X |
| 3,670,375 | 6/1972 | Cohn et al. | 26/57 E X |

FOREIGN PATENTS OR APPLICATIONS

| | | | |
|---|---|---|---|
| 916,861 | 1/1963 | United Kingdom | 26/57 E |
| 39-16239 | 10/1964 | Japan | 26/57 E |

*Primary Examiner*—Robert R. Mackey
*Attorney, Agent, or Firm*—Bailey & Dority

[57] ABSTRACT

The present invention relates to feeding fabric runs into tenter machines of the kind having lead-in rails adapted for movement to follow lateral deviations of the selvage edge of the fabric and, more particularly, to the drive apparatus for laterally moving the lead-in rails including a reversible driving motor carried by the lead-in rail and a capstan member rotatably driven by the driving motor. A cable member is looped around the capstan member having a first end connected on one side of the rail member and a second end connected on the opposite side of the rail member. A sensor means detects the lateral variations in the position of the selvage edge for generating an electrical signal which is then supplied to the driving motor for reversibly driving the capstan member moving the rail member laterally back and forth according to the lateral position of the selvage edge.

7 Claims, 2 Drawing Figures

DRIVE APPARATUS FOR TENTER FRAMES

BACKGROUND OF THE INVENTION

At the entrance to fabric tentering frames, it is necessary to properly position the lead-in rails having traveling pin chains carried thereon for engaging the selvage of the fabric and moving the fabric forward along a tentering frame. The lead-in rail members must be accurately positioned in response to the lateral variations in the position of the selvage edge as the fabric is fed onto traveling pins so as to uniformly align and place the selvage on the pins.

Many devices have been heretofore proposed for solving the problem of positioning the lead-in rail at the selvages of the cloth such as shown in U.S. Pat. Nos. 2,673,384, 3,150,431, and 3,216,081. However, such devices provide only limited traction for driving the movable infeed rail member back and forth to uniformly engage the fabric selvage. Since it is often necessary to change the direction of the rail member instantaneously, such devices become incapable of such movement due to wear of the drive apparatus.

When rack and pinion gear arrangements are used, the teeth of the gear members become worn due to the continuous sudden changing of lateral directions resulting in excessive play between the gear members and inaccurate responsive movement of the rail member.

SUMMARY OF THE INVENTION

A drive apparatus is provided for accurately positioning a movable lead-in rail member laterally on a tenter frame for textile fabrics and the like. The rail member is pivotably attached at one end thereof to the tenter frame and is slidably supported at an opposite end thereof on a transverse support member. An endless traveling chain member is carried by the rail member having upwardly extending pins for receiving and engaging a selvage of the fabric to move the fabric forwardly along the tenter frame. The drive apparatus pivots the rail member about the pivot axis thereof in response to lateral variations in the position of the selvage edge of said fabric. The drive apparatus includes a reversible driving motor carried by the rail member and a capstan member rotatably driven by said driving motor. A cable member looped around said capstan member has a first end connected to the support member on one side of the rail member and a second end connected to the support member on the opposite side of the rail member. A sensor means is provided for detecting the lateral variations in the position of the selvage edge of the fabric and for generating an electrical signal corresponding to the position. The electrical signal is supplied to the driving motor for reversibly driving the capstan member pulling the rail member back and forth along the cable member according to the lateral position of said selvage edge to accurately and uniformly align the selvage on the pins carried by the endless traveling chain member. Thus, the fabric will be fed into the tentering machine with the selvage edges parallel and in a straight line.

Accordingly, an important object of the present invention is to provide a drive apparatus for accurately positioning a movable rail member laterally on a tenter frame for textile fabric in response to lateral variations in the position of the selvage edge of the fabric.

Another important object of the present invention is to provide a drive apparatus for accurately positioning a movable rail member laterally on a tenter frame which provides increased traction for moving the rail member.

Another important object of the present invention is to provide a drive apparatus for accurately positioning a movable rail member laterally on a tenter frame providing increased traction and instantaneous change of lateral direction.

Another important object of the present invention is to provide a drive apparatus for accurately positioning a movable rail member laterally on a tenter frame minimizing wear between the drive engaging members of the drive apparatus.

Still, another important object of the present invention is to provide a drive apparatus for accurately positioning a movable rail member laterally on a tenter frame having a traveling pin chain so that the fabric will be fed into the tenter machine with its selvage edges parallel and in a straight line.

The construction designed to carry out the invention will be hereinafter described, together with other features The invention will be more readily understood from a reading of the following specification and by reference to the accompanying drawing forming a part thereof, wherein an example of the invention is shown and wherein:

DESCRIPTION OF A PREFERRED EMBODIMENT

The apparatus of the present invention may be incorporated in any conventional tentering machine, such as shown in U.S. Pat. No. 3,670,375 and since such machines are well known in the art, it will be unnecessary to disclose or describe a complete tentering machine herein.

Figure 1:
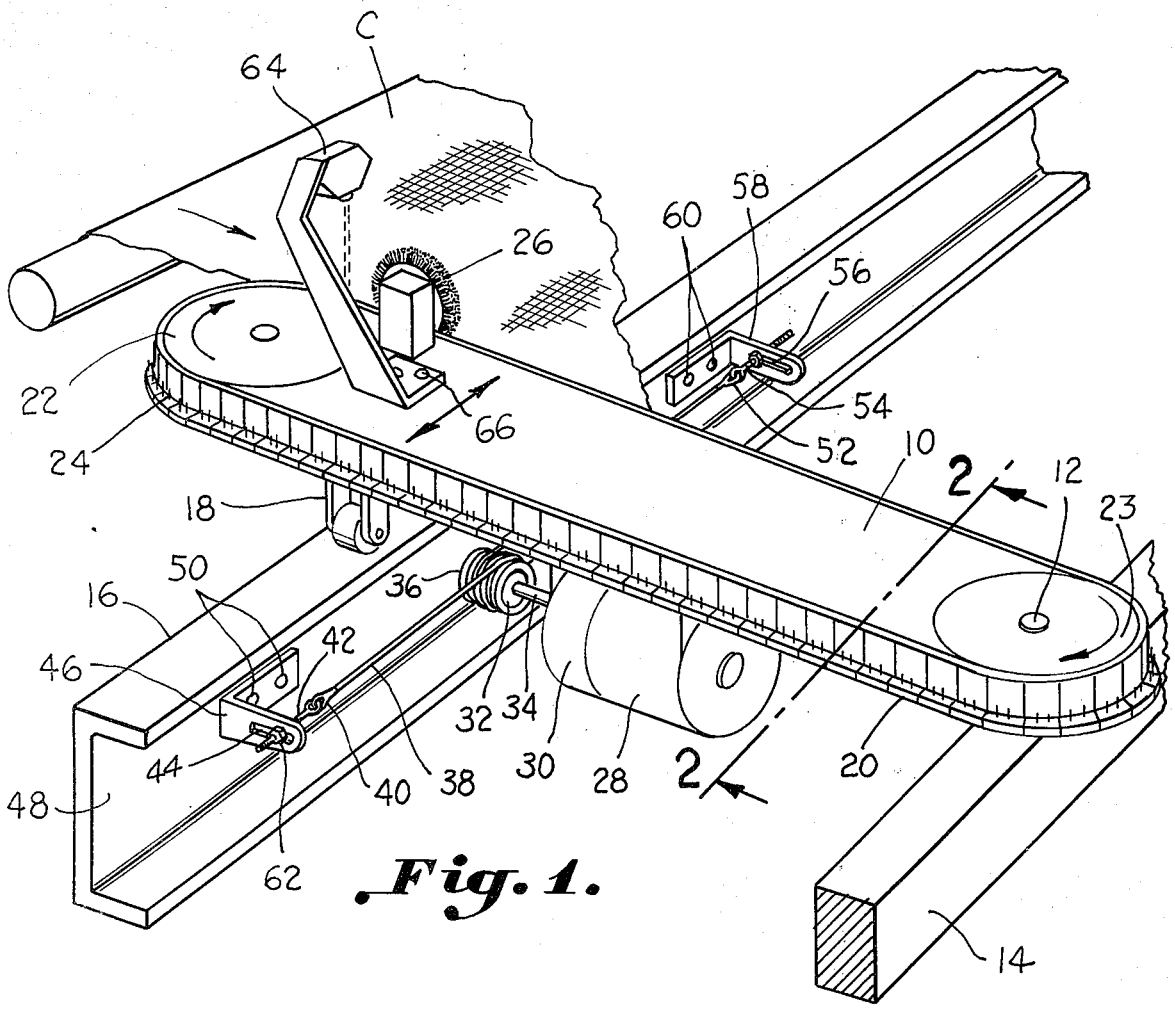
FIG. 1 is a perspective view illustrating one of a pair of lead-in rail members for feeding cloth into a tentering machine having a drive apparatus constructed in accordance with the present invention.
Figure 2:
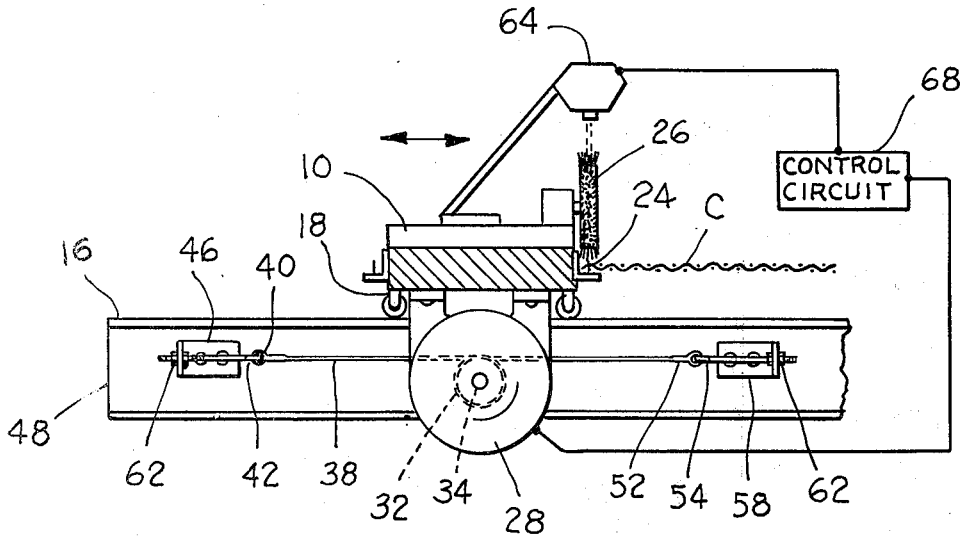
FIG. 2 is a view taken along line 2—2 of FIG. 1.

Accordingly, FIG. 1 of the drawing shows only so much of a conventional tentering machine as is necessary to illustrate the application thereto of the present invention..

FIG. 1 illustrates a drive apparatus for laterally moving a conventional pivoted lead-in rail member having a traveling pin chain carried thereon for feeding fabric into a tentering machine. A pair of lead-in rail members are conventionally utilized to engage the selvage or margin along both sides of the fabric being fed into the tentering machine. Only a single such lead-in rail is shown in the drawing for purposes of illustrating the drive apparatus of the present invention since a duplicate of the drive apparatus need be provided for the other rail member. Each lead-in rail is moved independently of the other and each is provided with a separate sensor for sensing the edge of the selvage and a drive apparatus for moving the lead-in rail in response to the position of the selvage so as to follow the selvage.

A movable lead-in rail member 10 has one end pivotably attached to a frame portion 14 of the tentering machine by vertical pin 12 or by any other suitable means that tenter frame manufacturers may use. The frame portion 14 is slideably supported at the opposite end on a transverse support member 16 such as by a roller member 18 carried on the rail member 10 which rolls over the support member. An endless traveling chain member 20 travels around the rail member 10 on sprocket members 22 and 23. The endless chain is driven by a conventional electric motor drive arrangement (not shown) in which sprocket 22 is driven and sprocket 23 is an idler sprocket which is rotatably carried on the pin 12. Carried on the traveling chain 20 is a plurality of tentering pins 24 which engage and receive the selvage of the fabric C to move the fabric forwardly along the lead-in rail member 10 to the tentering machine. As an alternative to thetentering pins 24, it is to be understood that other suitable fastening means for engaging and holding the fabric selvage may be utilized such as clips. The details of rail member, sprocket members 22, 23 and pins 24 are not shown since such could be any standard devices presently being utilized. While the run of the chain 20 is shown in the horizontal position it is to be understood that apparatus constructed in accordance with the present invention could also be used on frames where the run of the chain is in a vertical position.

As the fabric C is fed into the lead-in rails, a rotating brush member 26 or the like is utilized to push the fabric down onto the tentering pins 24 in a conventional manner.

As the fabric feeds into the entrance end of the lead-in rail member 10, it is necessary to position the lead in rail to accurately follow the position of the selvage of the cloth so as to align the selvage accurately over the tentering pins 24. The drive apparatus constructed in accordance with the present invention is highly sensitive and responsive to the position of the selvage to move the pivoted lead-in rail member 10 accordingly. The drive apparatus includes a reversible driving motor 28 affixed to the underneath bottom portion of the movable rail member 10. A conventional planetary reduction gear assembly 30 is provided for reducing the output speed of the motor. One suitable motor utilized in the drive apparatus is a model 56, 90 volt, continuous duty, reversible D.C. motor, manufactured by the Reliance Company of Columbus, Indiana. A suitable planetary reduction gear unit is manufactured by the Sumitomo Machinery Corporation of America, Carlstadt, New Jersey, Model No. H 52AXHS.

A capstan member 32 is affixed to the output shaft 34 of the planetary gear drive 30 and is thus rotatably driven by the reversible driving motor 28. In a preferred embodiment, the capstan member is provided with helical grooves 36 within which a cable member 38 is received when looped around the capstan member. However, a capstan member provided with a smooth surface may also be utilized in the drive apparatus. The capstan member is provided in a cylindrical form. However, it is to be understood that other forms or shapes of the capstan member may be utilized.

The cable member 38 is preferably looped around the capstan member 32 at least twice for improved traction and further traction may be provided by making further loops of the cable member around the capstan member. One end of the cable member 40 is looped through the eye portion of a conventional eye bolt member 42. The eye bolt member is received through a slot 44 in an L-shaped bracket 46 affixed to an interior vertical side surface 48 of the transverse support member 16. Bracket 46 may be affixed in any suitable manner such as bolt members 50. The slot 44 is elongated so that the eye member may be adjusted lengthwise in the slot. The opposite end 52 of the cable member 38 is fastened to a similar eye bolt member 54 which is received through a slot 56 in a similar L-shaped bracket 58 which is affixed by bolt members 60 to the side surface 48 of the transverse support member 16. The cable end 40 is connected on one side of the movable rail member 10 and the cable end 52 is connected on the opposite side so that as the motor, attached to rail member 10, drives the capstan member 32 along the cable, the rail member 10 is pulled back and forth, accordingly.

The eye-bolt member 42 is provided with a conventional nut member 62 received over a threaded end thereof, as is the eye-bolt member 54, securing the eye-bolt members to the brackets 46 and 58. It is important that the ends of the cable member 38 be laterally offset with respect to each other so that the cable member will not bind upon itself on the capstan member 32. In the illustrated embodiment, the cable end 40 would be positioned toward the outer end of slot 44 away from the side surface 48 of the support member 16. The eye bolt member 54 securing the other end 52 of the cable member would be positioned toward the inner end of slot 56 towards the vertical side 48 of the support member 16 so that the cable ends 40 and 52 will be laterally offset from each other and so the loops of the cable member 38 around the capstan member 32 will not bind upon each other as the capstan member reversibly rotates.

A sensor means is provided for detecting the lateral variations in the position of the selvage edge of the fabric and for generating an electrical signal responding to the position. Any suitable mechanical or optical sensor be utilized beutilized and one such sensor is disclosed in U.S. Pat. No. 3,216,081. In a preferred embodiment, a coaxial optical sensor is utilized wherein in a vertically extending light beam follows the edge of the selvage with half of the light beam on the fabric and selvage and half of the light beam off of the selvage. The sensor control system would then respond to the amount of the beam which is coaxially received back into the sensor unit 64. The sensor 64 is attached in any suitable manner to the lead-in rail 10 such as by bolt member 66. The sensor unit is positioned at the entrance to the lead-in rail member 10 directly over the tentering pins 24 and the selvage of the fabric so as to detect any lateral deviations in the position of the selvage with respect to the tentering pins 24. One suitable optical sensor is of the coaxial type photo sensor.

The control signals produced by the sensory unit 64 are fed to any suitable control circuit 68 which supplies electrical signals to the D.C. driving motor 28 for reversibly driving the capstan member 32 pulling the movable rail member 10 back and forth to follow the lateral position of the selvage edge. The control circuit 68 operates the driving motor 28 as a motor and a brake in both the clockwise and counterclockwise directions by inputting reference signals to the motor of varying amplitude and polarity. For example, a reference signal is normally plus or minus 0 to 10 volts. When their reference signal is positive, the motor will rotate in one direction and when the reference signal is negative the motor will rotate in the opposite direction. Should the reference signal be decreased in value, for example, +8 volts to +4 volts, the motor will act as a brake until its speed match the speed called for by the reference signal. The polarity and amplitude of the signal produced by the coaxial optical sensor 64 varies according to portions of light beam striking the selvage and missing the selvage. For example, if more than one half of the light beam is on the selvage the signal is of one polarity and when more than one half of the light beam is off the selvage the signal has the opposite polarity. when the light beam is exactly half off and half on the selvage, a null or zero signal will be produced.

The capstan member 32 and cable 38 provide a unique drive apparatus for laterally moving the pivoted lead-in rail member 10. The cable 38 may be looped around the capstan member 32 the desired amount of times and then the ends of cable member may be attached to the brackets 46 and 58. The tension of the cable held between brackets 46 and 58 may be adjusted by adjusting the nut members holding each of the eyebolts 42 and 54 in place. When the cable member 38 is looped around the capstan member 32 the desired number of times, the proper tension is placed on the cable 38, and the ends of the cable 40 and 52 are laterally offset from each other correctly, rotation of the capstan 32 by the electric motor will drive the rail member 10 back and forth in a highly responsive manner. Preferably, the cable member 38 is looped around the capstan member 32 twice, providing almost 720 deg. of traction surface between the capstan member and the cable ensuring a positive response of the pivotable rail member 10 to the rotation of the capstan member 32. Thus, a highly sensitive and responsive drive apparatus is provided for moving the pivoted rail member 10. Since the traction is rather evenly distributed around the capstan member 32 and the cable member 38 in contact therewith, as the capstan member turns along the cable member, much of the wear associated with conventional drive assemblies is reduced.

In operation, as the sensor unit detects variations in the position of the selvage edge of the fabric entering at the lead-in rail member 10, electrical signals representing the amount of variation are sent to the control unit 68 which, in turn, supplies an electric signal to the driving motor 28 for reversibly driving the capstan member 32, pulling the rail member 10 back and forth along the cable to follow the lateral position of the selvage edge. The highly sensitive and responsive drive apparatus moves the rail member 10 to follow the selvage of the fabric accurately to align the selvage on the tenter pins 24. When the drive apparatus constructed in accordance with the present invention is provided on each of the movable lead-in rail members of a tentering frame for feeding material into the tentering machine, the lead-in rail members follow the selvage of the material very accurately so as to feed the fabric into the tentering machine with the selvage edges parallel and in a straight line.

While a preferred embodiment of the invention has been described using specific terms, such description is for illustrative purposes only, and it is to be understood that changes and variations may be made without departing from the spirit or scope of the following claims.

What is claimed is:

1. A drive apparatus for accurately positioning a movable lead-in rail member on a tenter frame for textile fabric and the like, said rail member pivotably attached at one end thereof and slideably supported at an opposite end thereof on a transverse support member, an endless traveling chain member carried by said rail member having fastening means for receiving and engaging a selvage of said fabric to move the fabric along the tenter frame rail member, and said drive apparatus pivoting said rail member about the pivot axis thereof in response to lateral variations in the position of the selvage edge of said fabric as said fabric is fed onto said fastening means of said traveling chain member, said drive apparatus comprising:

a reversible driving motor carried by said rail member;

a capstan member rotatably driven by said driving motor;

a cable member looped around said capstan member having a first end fixed on one side of said rail member and a second end fixed on the opposite side of said rail member;

sensor means for detecting said lateral variations in the position of said selvage edge of said fabric and generating an electrical signal corresponding to said position; and means for supplying said electrical signal to said driving motor for reversibly driving said capstan member pulling said rail member back and forth along said cable member to follow the lateral position of said selvage edge;

whereby the selvage of said fabric is properly and uniformly aligned on said fastening means carried by said endless traveling chain member.

2. The apparatus of claim 1 wherein said capstan member is helically grooved for receiving said cable member within said grooves.

3. The apparatus of claim 1 wherein said reversible driving motor is affixed to the underneath bottom portion of said pivotable rail member.

4. The apparatus of claim 1 wherein said first end of said cable member is connected to said transverse support member on one side of said rail member and said second end of said cable member is connected to said transverse support member on the opposite side of said rail member.

5. The apparatus of claim 1 wherein said first end of said cable member and said second end of said cable member are connected so as to be laterally offset with respect to each other reducing the tendency of said cable member looped around said capstan member to bind against itself.

6. The apparatus of claim 1 wherein said sensor means includes an optical coaxial light sensor.

7. The apparatus of claim 1 wherein said fastening means are upwardly extending pins.

* * * * *